US008536991B2

(12) United States Patent
Gilbert

(10) Patent No.: US 8,536,991 B2
(45) Date of Patent: Sep. 17, 2013

(54) WIRELESS DECORATIVE DOORBELL DEVICE

(76) Inventor: Spencer O. Gilbert, Mansfield, TX (US)

( * ) Notice: Subject to any disclaimer, the term of this patent is extended or adjusted under 35 U.S.C. 154(b) by 196 days.

(21) Appl. No.: 13/134,260

(22) Filed: Jun. 2, 2011

(65) Prior Publication Data

US 2012/0306630 A1 Dec. 6, 2012

(51) Int. Cl.
*G08B 25/00* (2006.01)

(52) U.S. Cl.
USPC ..... 340/287; 340/384.7; 340/326; 340/330; 116/279; 116/200; 116/148; 116/172

(58) Field of Classification Search
USPC ..... 340/287, 541, 326, 825.49, 384.7, 340/384.1, 330, 393.3, 693.9; 116/279, 200, 116/148, 172
See application file for complete search history.

(56) References Cited

U.S. PATENT DOCUMENTS

| | | | | |
|---|---|---|---|---|
| 5,604,478 | A | 2/1997 | Grady et al. | |
| 5,883,570 | A * | 3/1999 | Lusareta et al. | 340/384.7 |
| 2004/0257222 | A1* | 12/2004 | Bentley | 340/539.1 |
| 2006/0290477 | A1* | 12/2006 | Cole et al. | 340/384.7 |
| 2008/0105523 | A1* | 5/2008 | Birdwell | 200/296 |
| 2010/0031541 | A1* | 2/2010 | Moyer | 40/299.01 |
| 2010/0045456 | A1* | 2/2010 | Koennecke et al. | 340/539.1 |
| 2011/0141741 | A1* | 6/2011 | Engstrom et al. | 362/257 |
| 2011/0227732 | A1* | 9/2011 | Hermanson et al. | 340/541 |

* cited by examiner

*Primary Examiner* — Hoi Lau
(74) *Attorney, Agent, or Firm* — Lynn E. Barber

(57) ABSTRACT

A decorative doorbell device is provided that includes a base unit attachable to a door and an ornamental housing unit rotatably lockable to the base unit. A doorbell ringer may be attached to the ornamental housing unit with a wireless activator so that a sound-producing unit is remotely activated by the wireless activator. The ornamental housing unit may be formed in the shape of a football helmet and decorated with a particular team's logo and colors on in any other desired ornamentation and shape.

5 Claims, 6 Drawing Sheets

WIRELESS DECORATIVE DOORBELL DEVICE

BACKGROUND OF THE INVENTION

1. Field of the Invention

This invention relates to door bell devices, and in particular relates to an ornamental doorbell device for alerting persons inside a house or building that a person is waiting at an entrance door.

2. Description of the Related Art

Door bells for alerting people to the presence of someone at the door are known. Such prior door bells are generally small hard-wired push button switches that when pushed complete an electric circuit resulting in the operation of an interior bell or chime. Wireless door bells also exist, as do novelty sound-producing devices that may be hung on a door and intercom devices.

A decorative door bell actuator is provided by the patent of Lusareta et al. (U.S. Pat. No. 5,883,570) and has a cover pivotally mounted on a surface with an adjustable lever extending out the back of the cover. When the cover is pressed toward the wall, the push lever rings the door bell and actuates an electronic circuit inside the cover causing light display, sound emission and movement of objects on the cover.

The patent of Grady (U.S. Pat. No. 5,604,478) is a pet operable door chime. There is a switch unit on the ground or floor, which when activated by a pet, causes a signal to be sent to a remote chime unit.

These prior door bells are either not decorative, are hard-wired, or include use of a preexisting doorbell.

It is an object of the invention to provide a decorative doorbell device that is wireless, in which an ornamental housing is attachable to a base unit mounted near a door of a building.

Other objects and advantages will be more fully apparent from the following disclosure and appended claims.

SUMMARY OF THE INVENTION

The invention herein is a decorative doorbell device that in its preferred embodiment includes a base unit attachable to a door; an ornamental housing unit rotatably lockable to the base unit; a doorbell ringer attached to the ornamental housing unit and having a wireless activator; and a sound-producing unit that is remotely activated by the wireless activator. The ornamental housing unit may be formed in the shape of a football helmet and decorated with a particular team's logo and colors, or in any other ornamentation and shape.

Other objects and features of the inventions will be more fully apparent from the following disclosure and appended claims.

DETAILED DESCRIPTION OF THE INVENTION AND PREFERRED EMBODIMENTS THEREOF

The present invention provides a preferably wireless, stand-alone doorbell device that may be attached to the wall of a building over an existing doorbell or in a position where there is no existing doorbell.

As used herein, the term "front" and "back" refer to the doorbell device as viewed when mounted on a wall. Thus, the front is the portion of the doorbell device closest to the person approaching and using the doorbell device, and the back is the portion of the device closest to the wall on which the doorbell device is mounted. The term "wall" includes any portion of a wall near a door, including the door jam or areas around the door as known in the art for mounting of doorbells.

Figure 1:
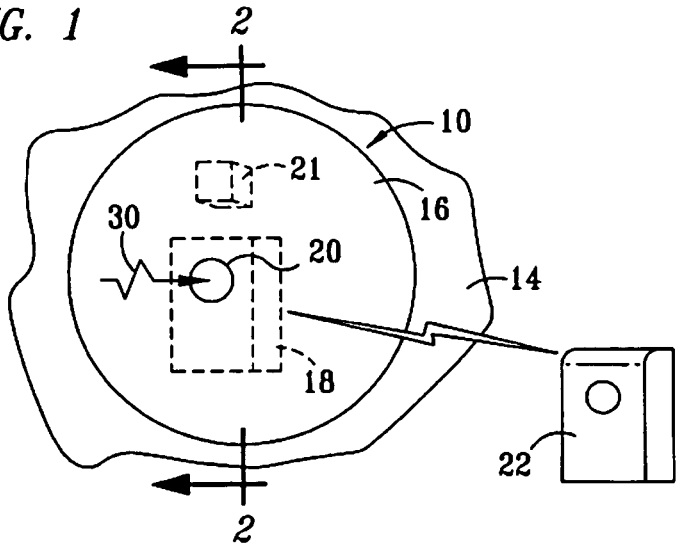
FIG. 1 is a schematic view of the doorbell device of the invention mounted on an outer wall of a building, showing the remotely located sound-producing unit.
Figure 2:
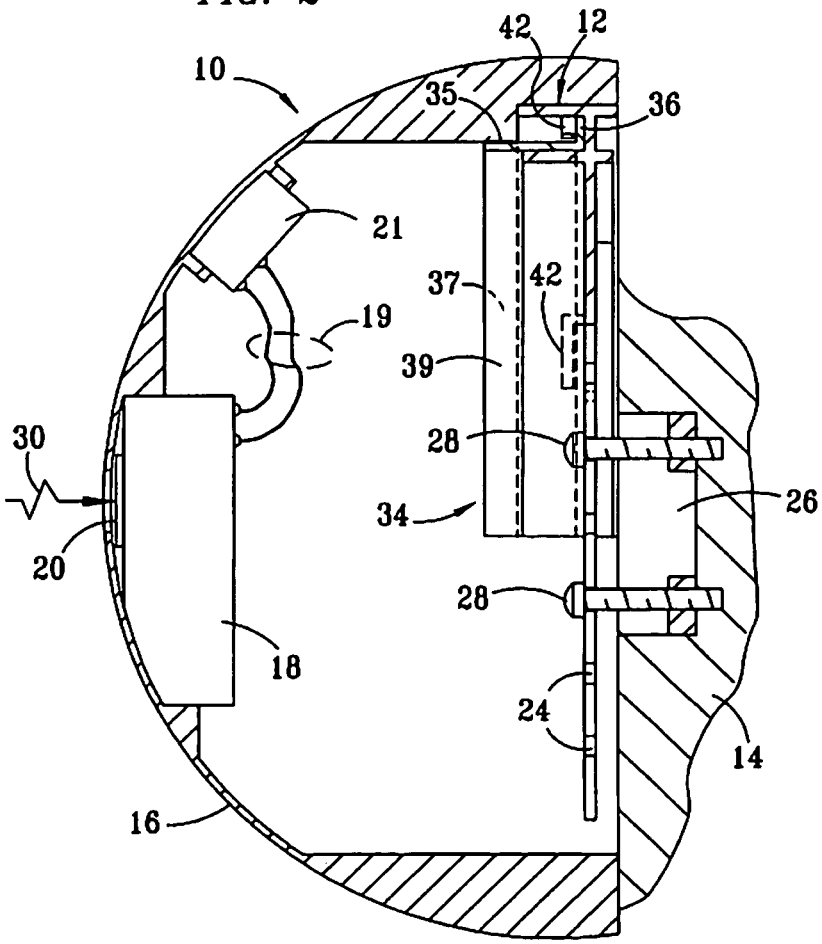
FIG. 2 is a cross-sectional view taken along line 2-2 of FIG. 1.
Figure 3:
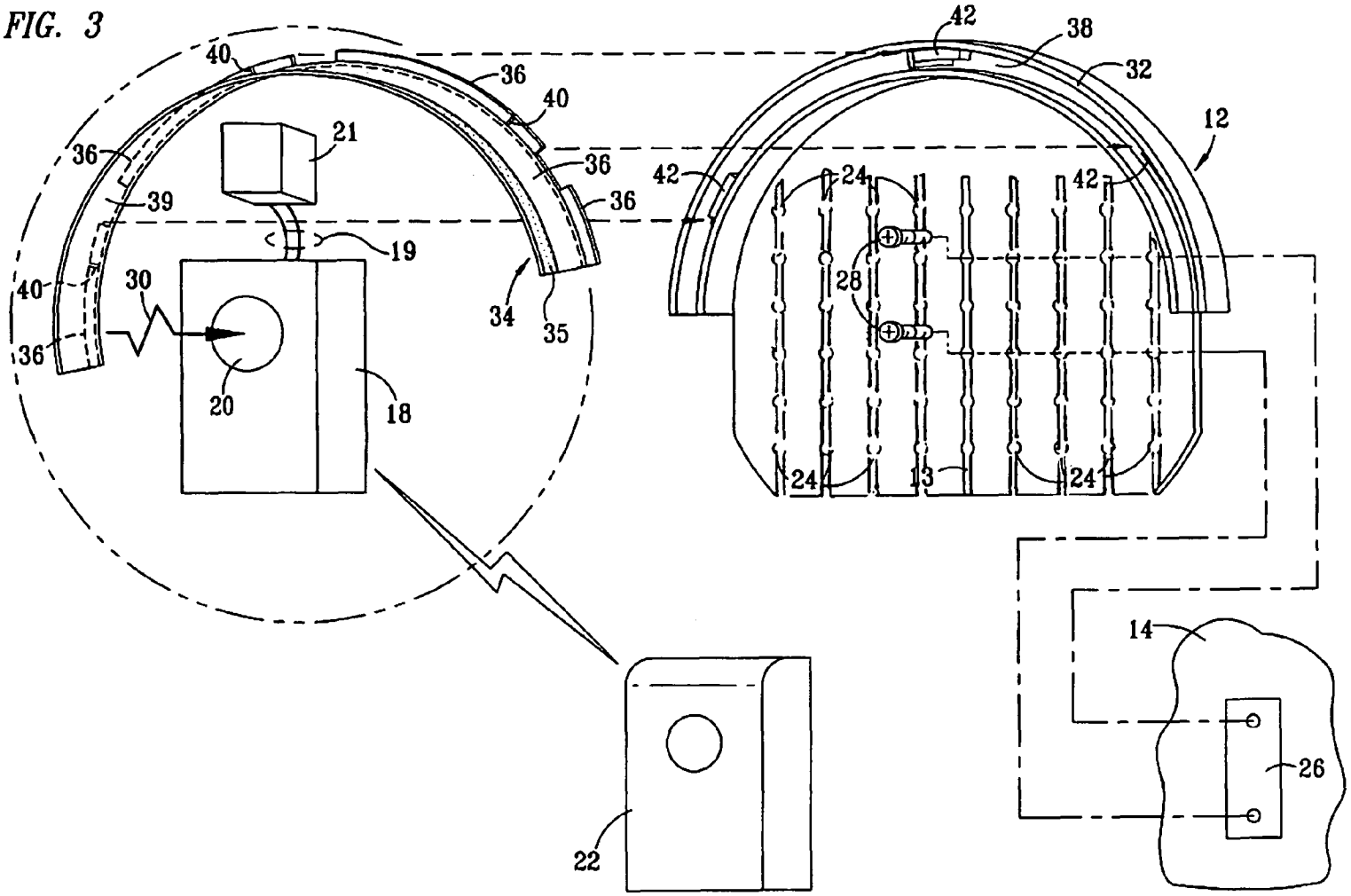
FIG. 3 is an exploded view of the doorbell device of FIG. 1.
Figure 4:
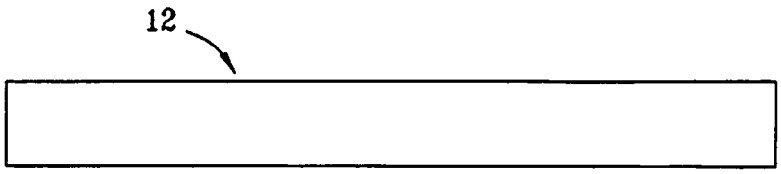
FIG. 4 is a top view of the base unit.

Referring now to the figures, the doorbell device 10 of the preferred embodiment of the invention comprises a base unit 12 (FIGS. 3-7) attachable to a wall 14 near a door; an ornamental housing unit 16 (FIGS. 3 and 12) rotatably lockable to the base unit 12; and a doorbell ringer 18 attached to the ornamental housing unit 16 (FIGS. 1-3).

Figure 5:
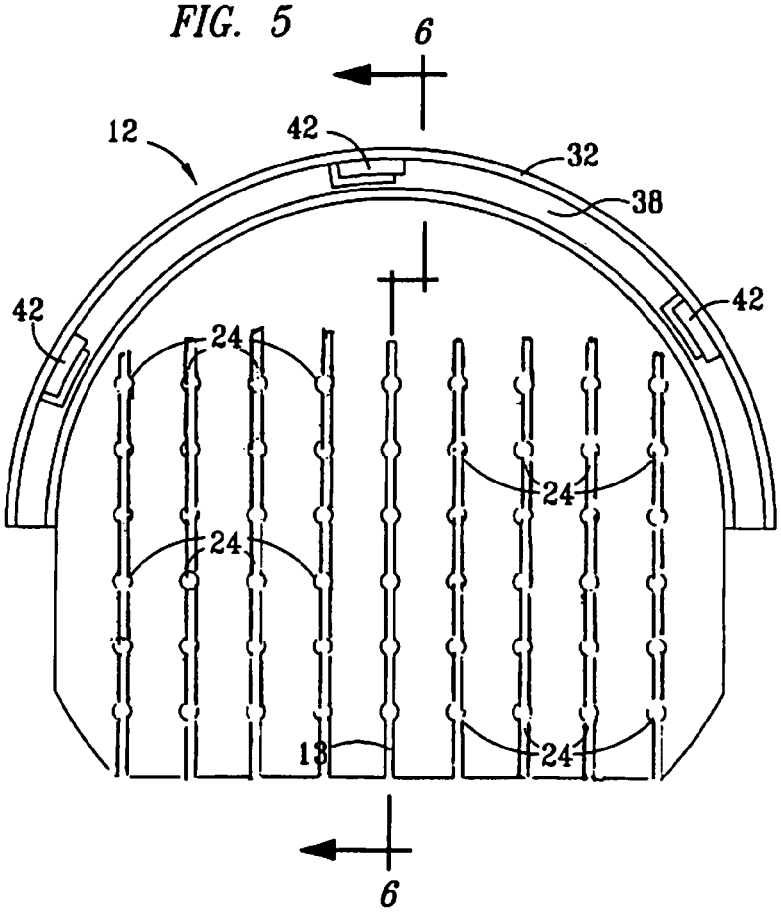
FIG. 5 is a front view of the base unit shown in FIG. 4.
Figure 6:
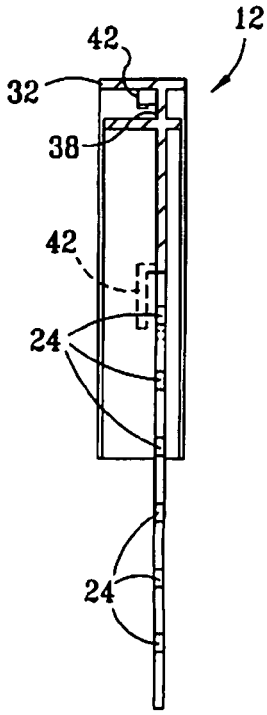
FIG. 6 is a cross-sectional view taken along line 6-6 of FIG. 5.
Figure 7:
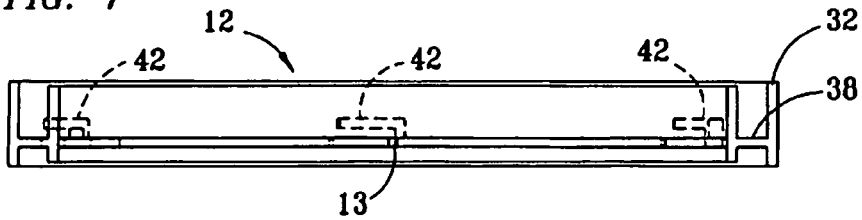
FIG. 7 is a bottom view of the device shown in FIG. 5.

Preferably, base unit 12 has a plurality of vertical splits 13 as shown in FIGS. 3 and 5. These vertical splits 13, shown as being along lines of holes 24, allows the location and position of the two sides of the base unit 12 that are formed by the splits 13 to be finely adjusted to fit particular screw locations on the surface on which the doorbell device 10 is to be mounted, so that selected holes 24 are correctly and easily aligned for placement of the screws 28 on the wall 14 or other surface.

Preferably the doorbell device 10 further comprises a wireless activator 20 attached or incorporated into the doorbell device 10, and a sound-producing unit 22 that is remotely activated by the wireless activator 10 as is known in the art (FIGS. 1 and 3). In the figures, the solid jagged line 30 with an arrow is a force applied symbol pointing to the wireless activator shows where a person's finger is to be placed to push and ring the sound-producing unit 22. The open jagged line indicates the wireless signal from the doorbell ringer 18/wireless activator 20 and the sound-producing unit 22. The sound-producing unit 22 may be battery-operated or may be an electrical plug-in unit as is known in the art.

As shown in FIG. 3, one or more extra components 21 may be included within the doorbell device 10 of the invention. Extra component 21 thus may comprise a vibrator attached to the wireless activator 20 by wiring 19 as known in the art so that when the doorbell ringer 18 is depressed not only is the sound-producing unit 22 activated but the vibrator is activated. For example if the ornamental housing unit 16 is designed to show a witch on a broom, activation, depression of the doorbell ringer 18 could cause the broom to vibrate. Alternatively, extra component 21 may comprise a light that is turned on by depressing the doorbell ringer 18. The light may be strategically located on the particular chosen ornamental housing unit 16, for example in the air hole of a helmet-designed ornamental housing unit 16 as discussed herein. Alternatively, the light may light up a feature on the ornamental housing unit 16, such as a star or logo or the headlights of a racecar.

The base unit 12 is the wall-mounting portion of the doorbell device 10 that is provided to enable the doorbell device 10 to be mounted on a home or other building. While the shape of the base unit 12 may be any that allows it to be mounted to a wall and further allows the ornamental housing unit 16 to be attached to the base unit 12, preferably the base unit 12 has a semicircular an arc-shaped outer perimeter portion 32. In the preferred embodiment herein, the base unit 12 has a plurality of holes 24 (FIG. 3). In this embodiment, the doorbell device 10 is attachable to a building wall 14 to replace an existing doorbell that is attached to the building by attachment screws. In the invention herein, the base unit is preferably placed in a position 26 where the prior doorbell had been located and screws 28 are placed through the holes 24 in the base unit 12 to attach the base unit 12 to the wall 14 of the building so that the base unit 12, and ultimately the doorbell device 10, is positioned where the doorbell had been positioned.

Alternatively, the base unit 12 may be mounted anywhere near a door of a building as is desired by screwing the base unit 12 in place at the desired location. Because the preferred doorbell device 10 of the invention is not hard-wired, but is wireless, so long as the sound-producing unit 22 is within the wireless range of the wireless activator 20, e.g. within the house in an entryway, the doorbell device 10 of the invention may be mounted anywhere that is accessible to being rung and can be noticed by someone approaching a door.

Figure 8:
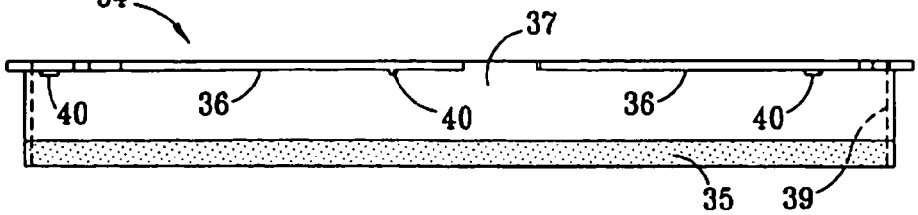
FIG. 8 is a top view of the cover mounting ring of the ornamental housing unit.
Figure 9:
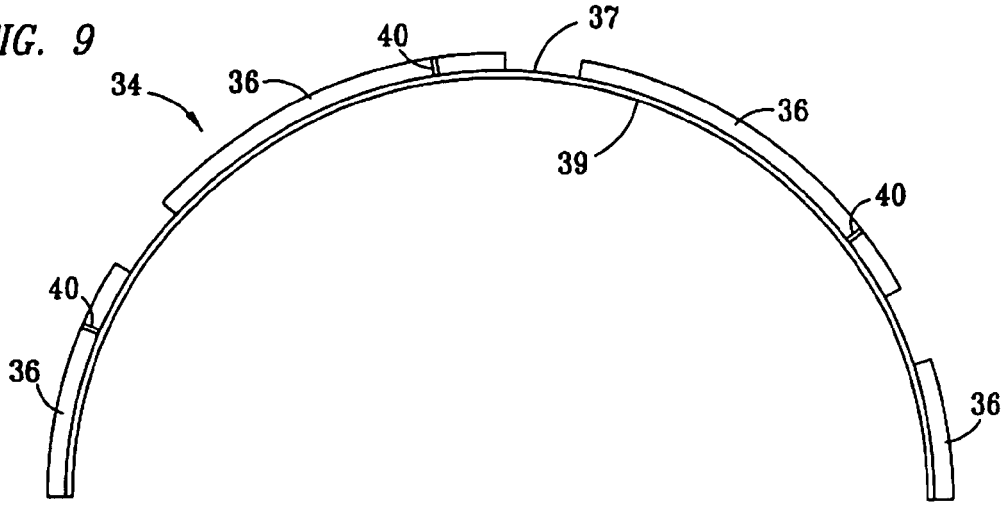
FIG. 9 is a front view of the cover mounting ring of FIG. 8.

The base unit 12 and the ornamental housing unit 16 are preferably rotatably attached together by any type of perimeter interlocking means. An example of such perimeter interlocking means that may be used for the invention herein is shown in FIGS. 3, 5, and 8-11. In this example, the ornamental housing unit 16 has a cover mounting ring 34 that includes a plurality of spaced outwardly projecting flanges 36 around the ornamental housing unit's perimeter. The flanges 36 are insertable in an outer perimeter track 38 on the base unit 12. Each outwardly projecting flange 36 has a stop 40 projecting perpendicularly from the flange (FIGS. 8-9 and 11). Within the outer perimeter track 38 is a plurality of locking slots 42 (FIGS. 5-7) into which the outwardly projecting flanges 36 may be rotated to lock the ornamental housing unit in place when the stops 40 each abut the edge of a locking slot 42 on the base unit 12. Other rotatable locking means as known in the art may be substituted for the preferred locking means without departing from the invention herein.

Figure 10:
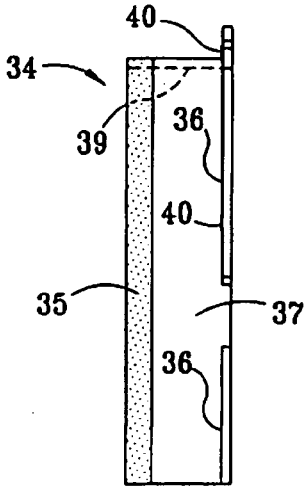
FIG. 10 is a side view of the cover mounting ring of FIG. 9.
Figure 11:
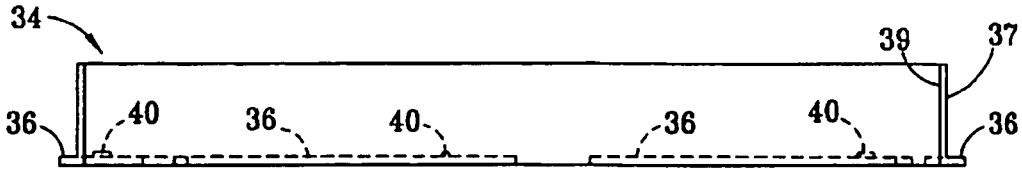
FIG. 11 is a bottom view of the cover mounting ring of FIG. 9.

As shown in FIGS. 3, 8 and 10, double sided tape or glue 35 may be used to mount the cover mounting ring 34. The arched surface 37 of cover mounting ring 34 may be affixed to the ornamental housing unit 16 by means of the double sided tape or glue 35 Alternatively, instead of using screws 28 to affix the invention to a wall or other surface, for example, where there is no prior doorbell or where the owner of the doorbell device 10 does not wish to for some other reason to screw the doorbell device 10 to the surface, double sided tape or glue 35 may be used to attach the doorbell device 10 to the surface.

Because the ornamental housing unit 16 and the base unit 12 are preferably separate pieces that may be attached to each other to form the resultant doorbell device, it is within the invention herein to have interchangeable ornamental housing units 16 so that the home-owner may select an ornamental housing unit 16 depending on the preferences of the home-owner. The home-owner may also change the ornamental housing unit over time.

In an alternate embodiment, the doorbell device 10 is as the preferred embodiment described above with the ornamental housing unit 16 and the base unit 12, but without a wireless activator or sound-producing unit. In this embodiment the doorbell device is installed over an existing doorbell and is of a size and shape so that in this embodiment, pressing the ringer 18 on the device 10 presses the existing doorbell.

While the doorbell device 10 of the invention preferably has a separate ornamental housing unit 16 and a separate base unit 12, the doorbell device 10 may be permanently attached together. As used herein permanent attachment includes being integrally made together. In this embodiment therefore, there is no need for these two components to be rotatably lockable together.

Figure 13:
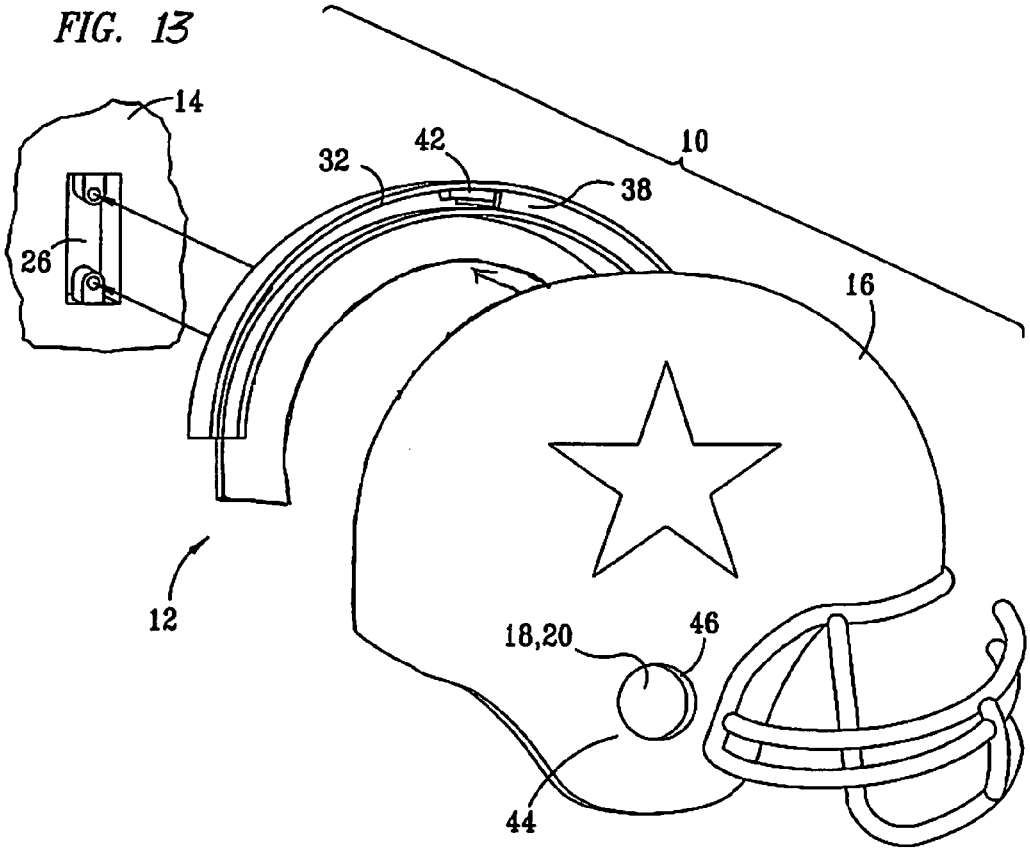
FIG. 13 is an exploded perspective view of an embodiment of the doorbell device of the invention not attached with screws to a building.

In another alternate embodiment of the invention shown in FIG. 13, the base unit 12 is in the form of a semi-circular back and does not have screw holes or vertical splits. Instead, the base unit 12 may be attached to a wall 14 by means of a strip of adhesive tape as is known in the art. The integral doorbell device 10 discussed above may also be made with a semi-circular back without screw holes, so that it is attachable with tape.

The ornamental housing unit 16 in one embodiment is formed to resemble a small (e.g., 5-inch diameter) football helmet that may further be marked and decorated to show a particular football team logo (FIGS. 12 and 13) and colors. When the ornamental housing unit is in the form of a football helmet having an ear protector area 44, the doorbell ringer 18 is preferably positioned behind an opening 46 in the ear protector area 44. Someone ringing the doorbell in this embodiment places a finger at the opening 46 and presses toward the back of the doorbell device 10, causing the doorbell ringer 18 that is mounted inside the ornamental housing unit 16 to ring. To further go along with the football theme, in this embodiment the indoor sound-producing unit 22 may further be marked with the team logo, and may be programmed, for example, with a chip as known in the art, with the football team's song or other desired sound(s).

Figure 12:
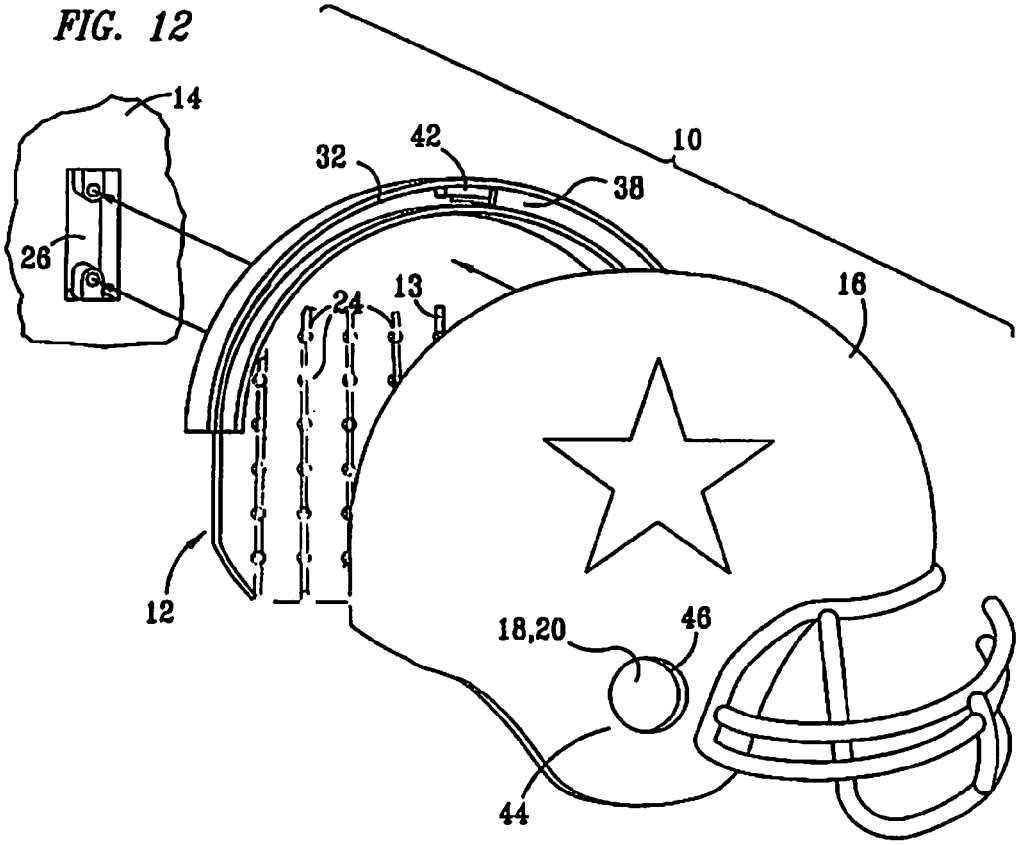
FIG. 12 is an exploded perspective view of one embodiment of the doorbell device of the invention herein.

While the ornamental housing unit 16 is shown in FIG. 12 in the form of a football helmet, other sports-related themes may be depicted by the shape of and/or decoration on, the ornamental housing unit 16 (e.g., a picture of a golf club, tennis racquet, soccer ball, race car etc., and/or sports team logo/name/color, and the like). Alternatively, the ornamental housing unit 16 may be designed in the form of any type of holiday or seasonal ornamentation (e.g., Thanksgiving turkey, snowman, Halloween pumpkin or witch, Christmas Santa Claus, etc.). The ornamental housing unit 16 may also be in the form or design of, or have depicted thereon, any other chosen appearance, such as logos, signs, animals (e.g., pony, frog, owl) and favorite other designs or appearances. It is also within the scope of the invention to optionally have the sound-producing unit 22 be coordinated in color and design, as well as in the sound that is produced, with the appearance of the ornamental housing unit 16.

While it is preferred that the doorbell device of the invention herein be wireless, the components of the preferred invention may be augmented by hard-wiring them by means known in the art.

While the invention has been described with reference to specific embodiments, it will be appreciated that numerous variations, modifications, and embodiments are possible, and accordingly, all such variations, modifications, and embodiments are to be regarded as being within the spirit and scope of the invention.

What is claimed is:

1. A doorbell device, comprising:

a) a base unit attachable to a door, the base unit having a semi-circular outer perimeter portion and a plurality of vertical splits having holes for attachment of the doorbell device to a wall;

b) an ornamental housing unit having a cover mounting ring;

c) a doorbell ringer attached to the ornamental housing unit and having a wireless activator; and d) a sound-producing unit that is remotely activated by the wireless activator, wherein the ornamental housing unit and the outer perimeter portion of the base unit are rotatably attached and locked together by a perimeter interlocking means.

2. The doorbell device of claim 1, wherein the doorbell device is attachable to a building to replace an existing doorbell that is attached to the building by attachment screws by placing the base unit over the existing doorbell and screwing the base unit to the building through the holes in the base unit so that the base unit is positioned where the doorbell had been positioned.

3. The doorbell device of claim 1, wherein the decorative unit is in the form of a football helmet having an ear protector area, and the doorbell ringer is positioned at the ear protector area.

4. The doorbell device of claim 1, wherein the cover mounting ring comprises a plurality of spaced outwardly projecting flanges around a perimeter of the ornamental housing unit, and the outer perimeter portion has a plurality of locking slots, wherein the flanges have stops and are insertable in the outer perimeter portion, wherein the ornamental housing unit may be rotated so that the outwardly projecting flanges are rotated in the outer perimeter portion and lock the ornamental housing unit in place when the stops abut the edge of a locking slot.

5. The doorbell device of claim 1, further comprising an extra component that is activated by the doorbell ringer, the extra component selected from the group consisting of a vibrator and a light.

* * * * *